United States Patent [19]

White et al.

[11] 4,144,619

[45] Mar. 20, 1979

[54] DRY-LAYING A WEB OF PARTICULATE OR FIBROUS MATERIAL

[75] Inventors: Derek G. W. White; Nicholas H. Holloway; Brian W. Attwood, all of Bristol, England

[73] Assignee: Karl Kroyer St. Anne's Limited, Bristol, England

[21] Appl. No.: 777,856

[22] Filed: Mar. 15, 1977

[30] Foreign Application Priority Data

Apr. 2, 1976 [GB] United Kingdom ..... 13362/76

[51] Int. Cl.[2] ..... D04H 1/00

[52] U.S. Cl. ..... 19/304; 19/305

[58] Field of Search ..... 19/155–156.4; 425/80–83; 156/62.2, 62.4; 264/91

[56] References Cited

U.S. PATENT DOCUMENTS

| | | | |
|---|---|---|---|
| 562,338 | 6/1896 | Patterson | 19/156.3 |
| 2,152,901 | 4/1939 | Manning | 19/156.4 X |
| 2,218,338 | 10/1940 | Manning | 19/156.4 |
| 2,940,134 | 6/1960 | Heritage | 19/156.3 X |
| 4,014,635 | 3/1977 | Kroyer | 19/156.3 X |

FOREIGN PATENT DOCUMENTS

| | | | |
|---|---|---|---|
| 2554571 | 7/1976 | Fed. Rep. of Germany | 264/91 |
| 1142039 | 2/1969 | United Kingdom | 19/155 |

*Primary Examiner*—Dorsey Newton

*Attorney, Agent, or Firm*—Larson, Taylor and Hinds

[57] ABSTRACT

Apparatus for dry-laying cellulosic fibres on a foraminous travelling band comprises a distribution chamber one wall of which facing the band is provided by a vibratable screen. Within the chamber is a rotating brush roll positioned so that the brushes cause the screen to vibrate. Fibres are urged through the screen partly by the action of the brush roll. Provision may be made for recirculating air which has passed through the band back to the chamber.

11 Claims, 4 Drawing Figures

DRY-LAYING A WEB OF PARTICULATE OR FIBROUS MATERIAL

This invention relates to dry-laying a web of particulate or fibrous material, particularly cellulosic fibrous material.

According to a first aspect of the present invention there is provided apparatus for dry-laying particulate or fibrous material entrained in a gaseous medium onto a endless forming band to form a web thereon, comprising a vibratory mesh screen above the forming band, means for vibrating the screen, and means for feeding the entrained particulate or fibrous material to the screen, the arrangement being such that, in operation the particulate or fibrous material passes through the screen and deposits on the forming band.

There is preferably provided above the screen a cylindrical brush roll rotatable about an axis parallel to the plane of the screen, and means to rotate the brush roll, the arrangement being such that rotation of the brush roll assists the passage of the material through the screen.

The brush roll is preferably positioned so that it contacts the screen, whereby, in operation, rotation of the brush roll provides the means for vibrating the screen.

The screen preferably provides a wall portion of an enclosure or housing, the enclosure having an inlet for the entrained material. The screen may be resiliently mounted and may be provided with adjustable tensioning means.

The height of the axis of the brush roll above the screen and the speed of rotation of the brush roll are preferably adjustable.

The forming band is preferably foraminous and is provided with a vacuum box in the region underneath the screen.

The enclosure is preferably provided with a gaseous medium inlet directed at a portion of the screen downstream of the brush roll. This inlet may be arranged to recirculate into the enclosure particulate or fibre-containing gaseous medium from the vacuum box.

The enclosure may be provided with an exit duct arranged to recirculate surplus gaseous medium to the particulate or fibrous material inlet.

According to a second aspect of the present invention there is provided apparatus for dry-laying a web of particulate or fibrous material comprising dispensing means for passing a gasous medium containing entrained particles or fibres through a foraminous forming band so as to deposit the entrained particles or fibres thereon, wherein there is provided means to recirculate the gaseous medium through the band so as to recover any particles or fibres which may have passed therethrough.

The recirculation means is preferably provided by a vacuum box associated with the forming band and a duct leading from the vacuum box to the dispensing means.

Figure 1:
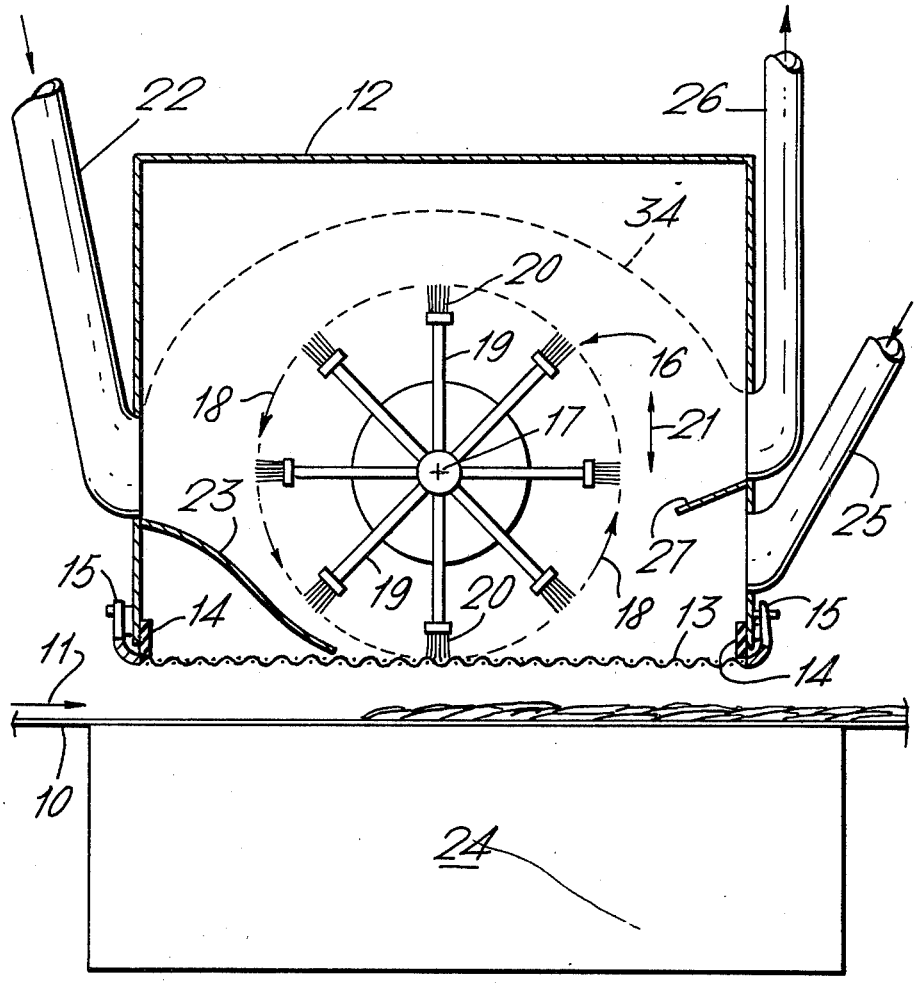
Figure 2:
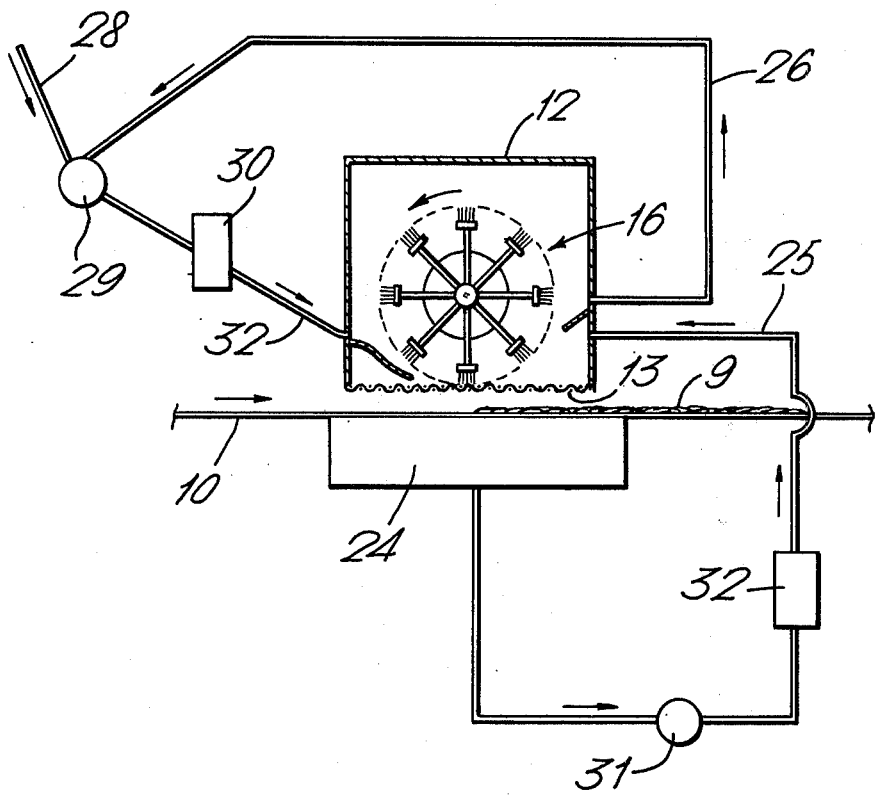
Figure 3:
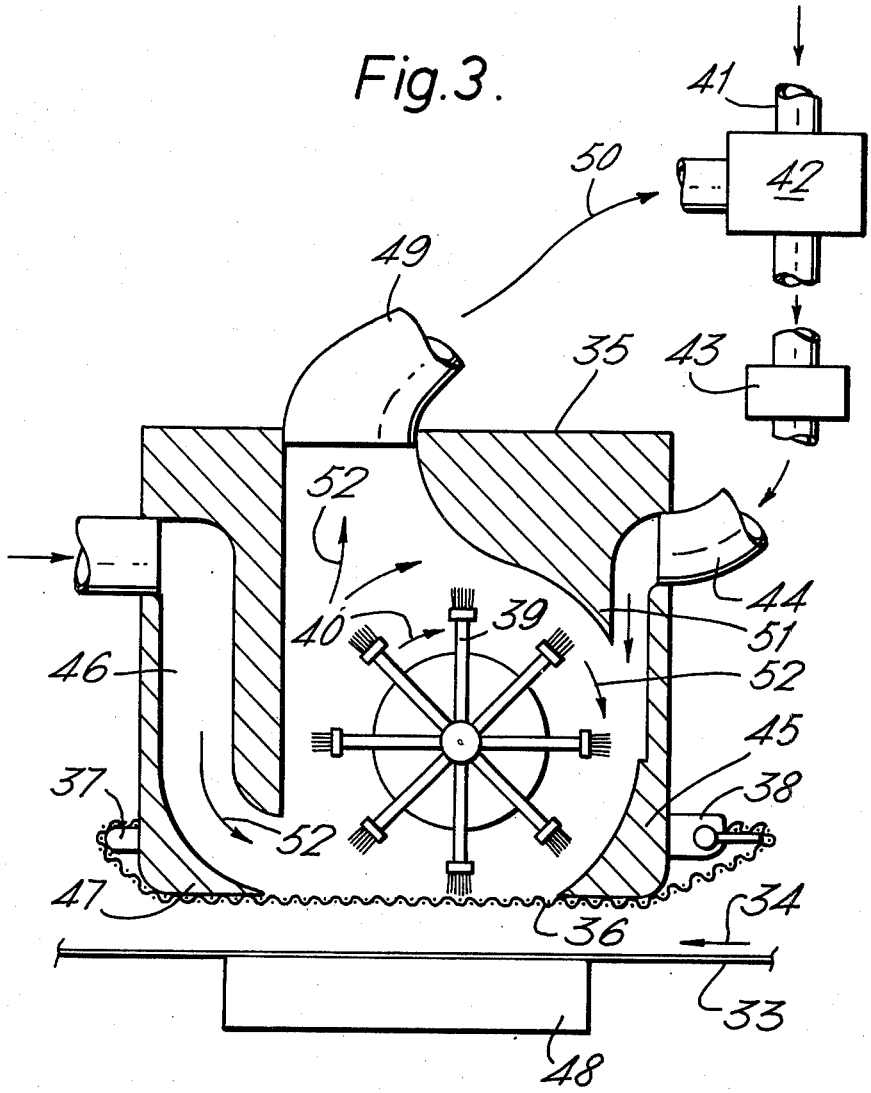
Figure 4:
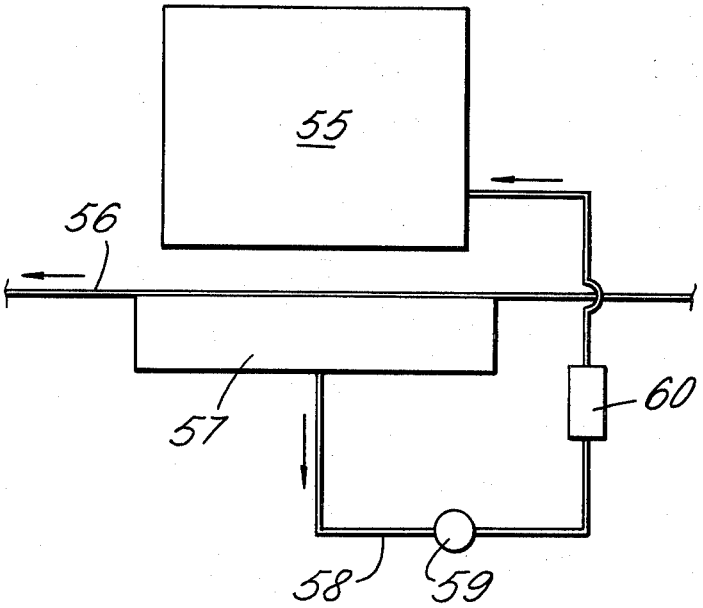

The invention will now be described by way of example with reference to the accompanying diagrammatic drawings in which, FIG. 1 is a vertical cross-section through an apparatus for dry-laying fibrous material to form a web, FIG. 2 is a vertical cross-section through the apparatus of FIG. 1, including a recirculation system, FIG. 3 is a vertical cross-section through an alternative embodiment of the invention and, FIG. 4 is a vertical cross-section through a dry-web laying apparatus incorporating a recirculation system.

Referring to FIG. 1 there is shown in longitudinal cross-section a continous foraminuous forming band 10 travelling in the direction of arrow ll. Positioned over the band and extending across its width is a rectangular enclosure or distributor box 12 the bottom wall of which is provided by a mesh screen 13 resiliently mounted on rubber mounts 14 located on side walls of the enclosure. The screen is maintained at a desired tension by adjusters 15 on the side walls.

Within the enclosure is a cylindrical brush roll 16 mounted for rotation about an axis 17 parallel to the plane of the screen 13 and transverse to the direction of travel of the band 10. A variable speed motor (not shown) is provided to rotate the brush roll at a required speed in the direction of arrows 18. The brush roll comprises paddles 19 each of which has a nylon brush 20 at its tip, and is positioned so that each brush, on the lower arc of its travel, contacts the screen 13, thereby setting it into vibration. The brush roll is adjustable for height, as indicated by arrows 21, so that the brushes 20 may be pressed against the screen at any required degree of pressure, or even raised clear of the screen if desired.

The enclosure is provided in the side wall upstream of the brush roll with an inlet manifold 22 which feeds cellulosic, e.g. wood, fibres entrained in an air stream towards the upstream nip between the brush roll and the screen. "Upstream" and "Downstream" in this specification are to be understood in relation to the direction of travel of band 10, that is, to the left hand and right hand sides respectively of the brush roll in FIGS. 1 and 2, and to the right hand and left hand sides respectively of FIGS. 3 & 4.

The inlet manifold 22 extends across the width of the band 10 and is provided with a lip 23 descending into the enclosure to the aforesaid upstream nip so as better to direct the airstream into the nip and to avoid dead space in the lower upstream portion of the enclosure.

A vacuum box 24 is provided under the band 10, immediately beneath the screen so as to draw air entraining the fibres through the band and leave the fibres deposited on the band to form a web 9.

An air inlet manifold 25, extending across the width of the band, is provided in the downstream side wall of the enclosure and is directed at that area of the screen downstream of the brush roll, its function being to prevent build-up of fibre in this area and consequent "blinding" or blockage of the screen.

In the same downstream side wall there is also provided an exit duct 26 to recirculate or otherwise remove surplus air from the enclosure. Interaction between manifold 25 and duct 26 is lessened by a baffle 27 extending into the enclosure from the downstream side wall.

Referring to FIG. 2, cellulosic fibres are fed through a feed line 28 into a hammer mill and fan 29 from where they are blown through a fibre concentrator 30, to remove excess air, into the enclosure 12. The fibres and entraining air pass through the vibrating screen 13 onto the forming band 10 through which the air is drawn by the vacuum box 24 operated by vacuum fan 31 to leave the fibres deposited as the web 9 on the band.

The exit air from the vacuum box normally contains a quantity of fibres and dust, starch powder etc. which have passed through the band. This exit air is passed through a concentrator 32, to remove excess air, and then fed back into the enclosure 12 through the air inlet manifold 25. The fibres which have passed through the band are thus recirculated for relaying on the web 9.

Any excessive air pressure in the enclosure is reduced by removing it through the duct 26 and recycling it to the hammer mill 29.

An alternative configuration for the top wall of the enclosure is indicated by dashed line 34 in FIG. 1.

Referring to FIG. 3 there is shown apparatus similar to that in FIG. 1. As in that FIG. there is shown in FIG. 3 in longitudinal cross-section a continous foraminous forming band 33 travelling in the direction of arrow 34. Positioned over the band and extending across its width is a distributor box 35 the bottom wall of which is provided mostly by a mesh screen 36 fixed at one end to a bracket 37 on the outside of the distributor box 35, and at the other end to a tension adjuster indicated diagrammatically at 38.

Within the distributor box 35 is mounted a cylindrical brush roll 39 identical to that described with reference to FIG. 1 and positioned and actuated in identical fashion. The brush roll 39 rotates in the direction indicated by arrow 40.

Cellulosic, e.g. wood, fibres are fed through a feed line 41 into a hammer mill and fan 42 from where they are blown entrained in air via a fibre concentrator 43 (to remove excess air) through an inlet manifold 44 into the distributor box 35.

The inlet manifold 44 directs the entrained fibres towards the upstream nip between the brush roll 39 and the screen 36. Manifold 44 extends across the width of the band 33 and is provided with a lip 45 descending into the box to avoid dead space in the lower upstream portion of the box.

An air inlet manifold 46 extending across the width of the band is provided in the downstream side wall of the enclosure and is directed by a lip 47 at that area of the screen downstream of the brush roll, as in FIG. 1.

A vacuum box 48 is provided under the band 33 immediately beneath the screen.

An exit duct 49 is provided in the roof of the distributor box opposite the screen to remove surplus air from the box or otherwise to recirculate it back to the hammer mill 42, as shown by arrow 50. Interaction between inlet manifold 44 and exit duct 49 is reduced by a baffle 51 extending into the box from the roof.

Arrows 52 indicate the general flow of air within the box.

In FIG. 4 there is shown in block diagram form a dry web laying apparatus incorporating a recirculation system. There is shown a dispensing means 55 for passing cellulosic fibres entrained in air through a foraminous moving band 56 so as to deposit the entrained fibres thereon. Entraining air is drawn by a vacuum box 57 through the band 56 and is recirculated through duct 58 via a vacuum fan 59 and a concentrator 60 to the dispensing means. The dispensing means may be as described in any of FIGS. 1–3.

In the typical embodiments described in FIGS. 1 to 3 the brush roll may be envisaged as having an overall diameter of 25 cm and being driven at about 690 revolutions per minute. These figures are not intended to be limiting in any way.

When the apparatus of the invention is used with cellulosic fibre, such as wood or pulped paper fibre, to make a web which can be subsequently consolidated into paper or carton board, e.g. by methods disclosed in our U.K. patent specification No. 1424682, suitable screen materials are brass, nylon and stainless steel and suitable mesh sizes lie in the range 26 to 10 per inch. For example, a mesh size of 10 in combination with a 3 mm hole screen in the hammer mill produces a good throughput of cellulosic fibres with low recirculation and a good web formation free of fibre bundles. The screen mesh may be entirely monofilament (plain or calendered), or have a multifilament warp and a monofilament or multifilament weft.

Control valves may be provided as required in the entrained fibre inlet, the air inlet, the exit duct, or the vacuum recirculatory duct, as required.

The passage of fibres through the screen is believed to be due to, (a) the vibration of the screen. The amplitude and frequency of vibration are controlled by the screen tension, its composition, and the speed of rotation and height of the brush roll;
(b) the rubbing of the brush roll on the screen. This may usefully cause further defibering of the fibres;
(c) the centrifugal and aerodynamic effect of the brush roll;
(d) the positive net air pressure inside the enclosure, and
(e) the vacuum box.

It is found with the invention that, by passing the cellulosic fibres through a vibrating screen a web is produced which has an acceptable cross-web profile and substantially free of conglomerated fibres or thin spots.

The invention is applicable to the formation of cellulosic webs in the weight range of 10–300 g/m$^2$, but weights outside this range are possible.

The invention is applicable to material other than cellulosic fibre, such as glass fibre, asbestos fibre, or plastics granules, and may use a gaseous medium other than air, such as nitrogen or other inert gas.

What we claim is:

1. Apparatus for dry-laying particulate or fibrous material entrained in air onto a moving foraminous forming band to form a web thereon, the apparatus comprising, (A) a fibre distributor, said fibre distributor comprising a housing and including:

(a) a vibratable planar screen forming a lower wall portion of said housing,
(b) a rotatable brush roll comprising circumferentially spaced brushes arranged for rotation about an axis above and parallel to said screen such that the brushes, when rotating, contact and thereby vibrate the screen,
(c) fibre inlet means for introducing fibre laden carrier air into said housing on one side of said brush roll,
(d) said brush roll being arranged for rotation in a direction such that the brushes are rotated in a path from the fiber inlet means on said one side of said brush, into contact with said screen, and towards the other side of said brush roll whereby the fibre-laden carrier air introduced into said housing through said fibre inlet is moved towards said screen by the rotating brushes,
(e) air inlet means for introducing air into said housing on said other side of said brush roll,
(f) means for introducing air through said air inlet to direct air against fibres moved by said brushes towards said other side of said brush roll to prevent blocking of said screen, and (g) outlet means for removal of surplus air from said housing;

(B) a moving foraminous forming band below the screen; and (C) a vacuum box below the forming band for drawing fibres down through the screen and onto the forming band to form a web thereon.

2. Apparatus according to claim 1 wherein said air inlet means comprises a manifold extending adjacent said other side of said brush roll and a lip member for directing air introduced therethrough towards the area of said screen adjacent said other side of said brush roll.

3. Apparatus according to claim 1 wherein said fibre inlet means comprises means for directing fibre-laden carrier air introduced therethrough downwardly towards said screen.

4. Apparatus according to claim 1 further comprising baffle means for directing fibre-laden carrier air towards said screen.

5. Apparatus according to claim 1 wherein said fibre inlet means and said air inlet means are located in opposite walls of said housing.

6. Apparatus according to claim 1 wherein said outlet means is located in a wall of said housing above said screen.

7. Apparatus according to claim 1 further comprising means for adjusting the tension of said screen.

8. Apparatus according to claim 1 wherein said screen comprises metal mesh.

9. Apparatus according to claim 1 further comprising a hammer mill, means for feeding fibres to said hammer mill, and means for feeding fibre-laden carrier air from said hammer mill to said fibre inlet means.

10. Apparatus according to claim 1 further comprising means for recirculating surplus air from said outlet means to said fibre inlet means.

11. Apparatus according to claim 1 further including means for recirculating air and any entrained fibres which pass through said forming band and into said vacuum box from said vacuum box to said air inlet means.

* * * * *